US007269859B2

(12) United States Patent
Wells

(10) Patent No.: US 7,269,859 B2
(45) Date of Patent: Sep. 18, 2007

(54) MOISTURE PROOF GLOVE WITH A PROTECTIVE CUFF

(76) Inventor: Theresa Wells, 1273 Clifton Grn., Charlottesville, VA (US) 22901

( * ) Notice: Subject to any disclaimer, the term of this patent is extended or adjusted under 35 U.S.C. 154(b) by 0 days.

(21) Appl. No.: 11/344,092

(22) Filed: Feb. 1, 2006

(65) Prior Publication Data

US 2007/0192932 A1 Aug. 23, 2007

(51) Int. Cl.
*A41D 19/00* (2006.01)

(52) U.S. Cl. ..... 2/161.6; 15/227

(58) Field of Classification Search ..... 2/16, 2/20, 161.6, 162; 15/227
See application file for complete search history.

(56) References Cited

U.S. PATENT DOCUMENTS 2,641,767 A * 6/1953 La Rosa ..... 2/168
5,682,612 A * 11/1997 Schwarz ..... 2/161.6
6,092,237 A * 7/2000 Baldwin ..... 2/161.7
6,516,469 B1 * 2/2003 Schaetzel ..... 2/16
6,673,054 B1 * 1/2004 Gould et al. ..... 604/292

* cited by examiner

*Primary Examiner*—Katherine Moran
(74) *Attorney, Agent, or Firm*—Millen, White, Zelano & Branigan, P.C.

(57) ABSTRACT

A glove, such as a glove used for washing dishes or for cleaning has a sleeve with a cuff thereon. The cuff has an first portion which is adhered or bonded to the inside surface of the sleeve and a second portion which initially extends from the cuff. The first portion of the cuff seals with the wearer's arm, while the second portion of the cuff is pulled over the outside surface of the glove to absorb moisture running down the glove. The cuff is at least in part made of a moisture absorbing material and preferably contains an anti-bacterial agent.

14 Claims, 4 Drawing Sheets

MOISTURE PROOF GLOVE WITH A PROTECTIVE CUFF

FIELD OF THE INVENTION

The present invention is directed to moisture proof gloves and more particularly, moisture proof gloves with protective cuffs.

BACKGROUND OF THE INVENTION

Moisture proof gloves are used for many purposes, one of which is to protect the hands of the person immersing their hands in a liquid. An example of such gloves are waterproof dishwashing gloves or gloves used for other purposes, such as but not limited to cleaning, painting, or to gloves utilized for industrial purposes.

One drawback to such gloves is that moisture may enter the open end of the glove through which a person's hand is inserted, exposing the person's skin to the moisture. When washing dishes, the liquid is frequently soapy water which contains detergents and other components which can be irritable. Waterproof gloves are also used while cleaning or sanitizing household areas, such as bathrooms or utility areas which may contain bacteria that may in some instances prove harmful to the person doing the cleaning. This is especially the case in facilities such as hospitals or public restrooms.

In view of the aforementioned considerations, there is a need for moisture resistant or waterproof gloves which have cuffs effective to prevent liquid from entering into the gloves through the open end of a glove's sleeve.

SUMMARY OF THE INVENTION

A glove made of a moisture resistant material that provides a barrier for preventing fluid on an outside surface of the glove from contacting a wearer's skin which is adjacent to an inside surface of the glove. The glove has a hand covering portion and an arm covering skirt with an open end though which the wearer's hand is inserted. The glove is improved by a cuff having a first portion disposed within the skirt at a location adjacent to the open end of the skirt and a second portion extending away from the open end of the skirt. The first portion is fixed to the inside surface of the skirt and the second portion is constructed and arranged to extend over the outside surface of the skirt when pulled thereover. The second surface presents a barrier to liquid moving along the skirt.

In a further aspect, the cuff is made of a moisture absorbing fabric, and in still a further aspect the fabric includes an antibacterial agent.

BRIEF DESCRIPTION OF THE DRAWINGS

Various other features and attendant advantages of the present invention will be more fully appreciated as the same becomes better understood when considered in conjunction with the accompanying drawings, in which like reference characters designate the same or similar parts throughout the several views, and wherein.

DETAILED DESCRIPTION

Figure 1:
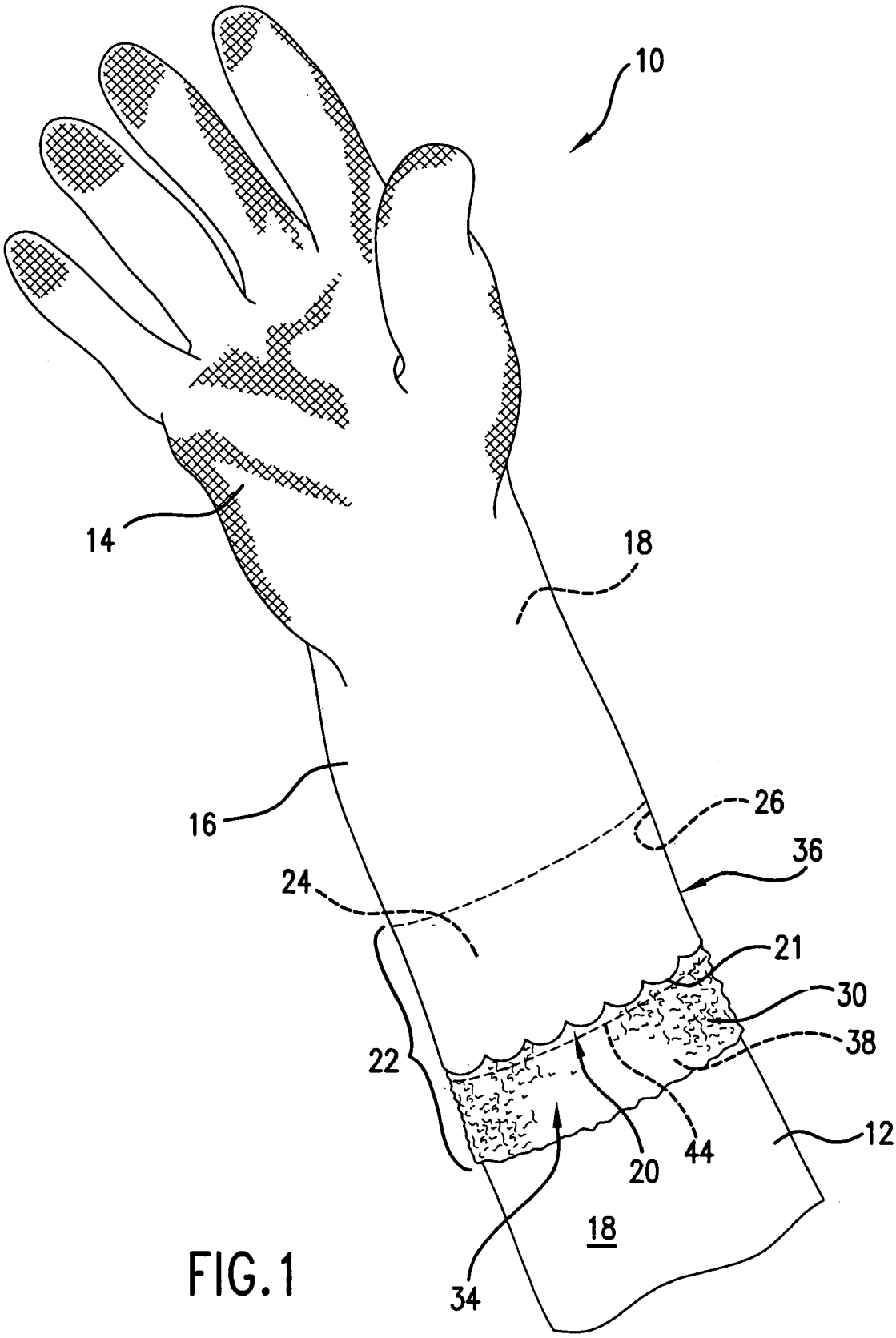
FIG. 1 is a perspective view of a glove having a cuff thereon configured in accordance with the present invention.

Referring now to FIG. 1, there is shown a glove 10, configured in accordance with the principles of the present invention, mounted on a person's arm 12. The glove 10 has a hand portion 14 and a sleeve portion 16. The hand portion 14 and the sleeve 16 are made of a material which is at least moisture resistant, and preferably moisture proof, so that moisture can penetrate neither the hand portion 14 nor the sleeve portion 16 to contact the skin 18 of the person's arm or hand. The glove may made be made of any suitable water resistant or moisture resistant material such as natural rubber, latex or any other waterproof material or lamination that protects the skin of a person wearing the glove. Typically, the glove is of the type used for washing dishes or for performing cleaning tasks which may utilize materials such as, but not limited to, bleaches or detergents.

In accordance with the present invention, the sleeve 16 has an open end 20 through which the person's hand and arm are inserted in order to wear the glove. The opening 20 may have an edge 21 which is scalloped or smooth. Extending from the opening 20 is a cuff 22 that in FIG. 1 extends past the opening 20 a distance in a range of about 1½ to 2 inches up the arm 12 of the wearer.

Figure 2:
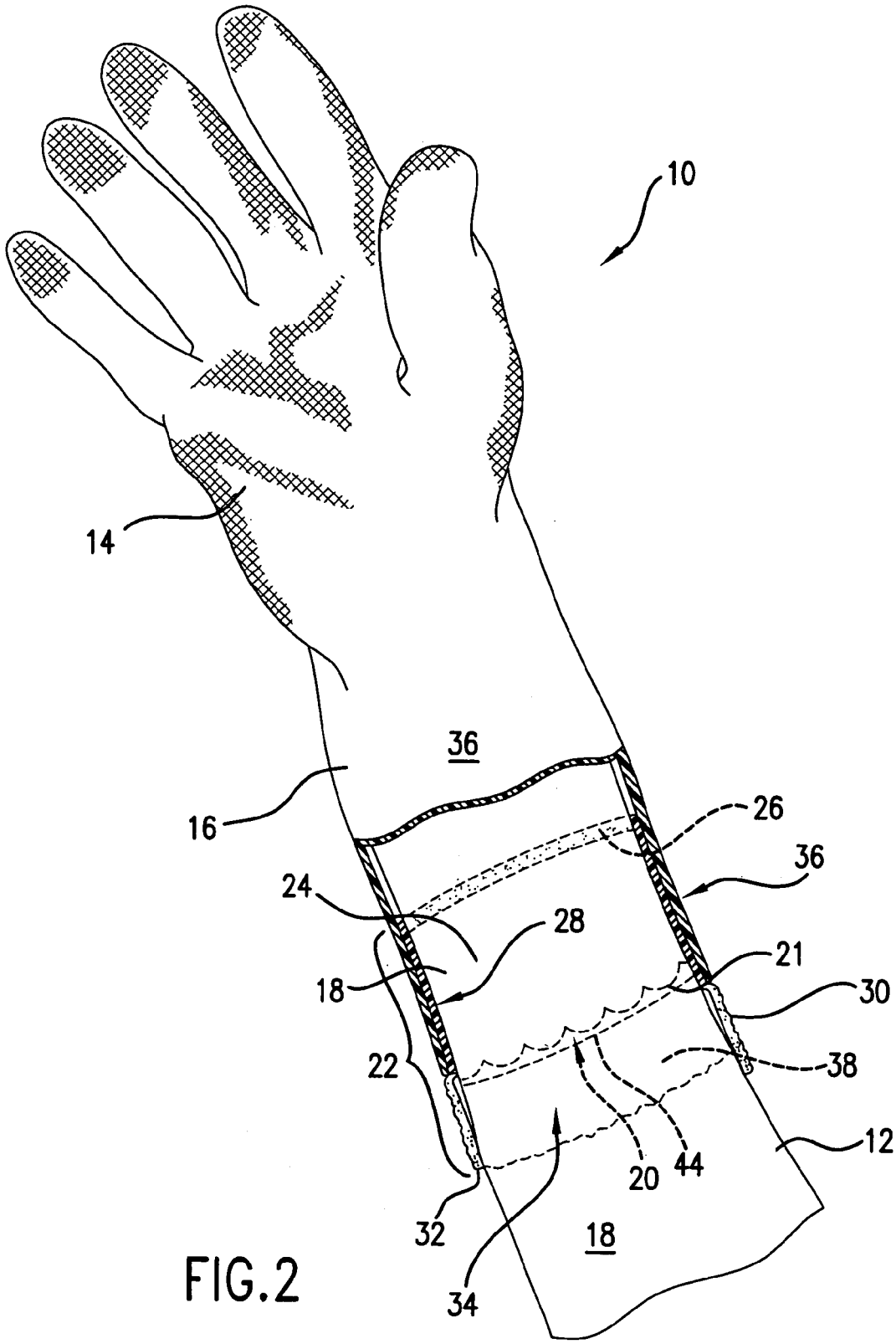
FIG. 2 is a perspective view similar to FIG. 1 but showing portions of the glove in elevation and in phantom.

As is seen in FIG. 2, the cuff 22 has a first portion 24 which is fixed by adhesive or bonding to the inner surface 26 of the sleeve 16 and extends preferably at least about 1 inch, and preferably about 3 inches, inwardly from the open end 20 of the sleeve. The first portion 24 may be secured by adhesive or by direct bonding to the inner surface 26. The first portion has an inner surface 28 which seals against the skin 18 of the person's arm 12 so as to prevent moisture or liquid from flowing between the inner surface 28 and the person's arm 12. The cuff 22 further has a second portion 30 which as is seen in FIGS. 1 and 2 extends past the opening 20 and provide an outer portion of the cuff.

Figure 3:
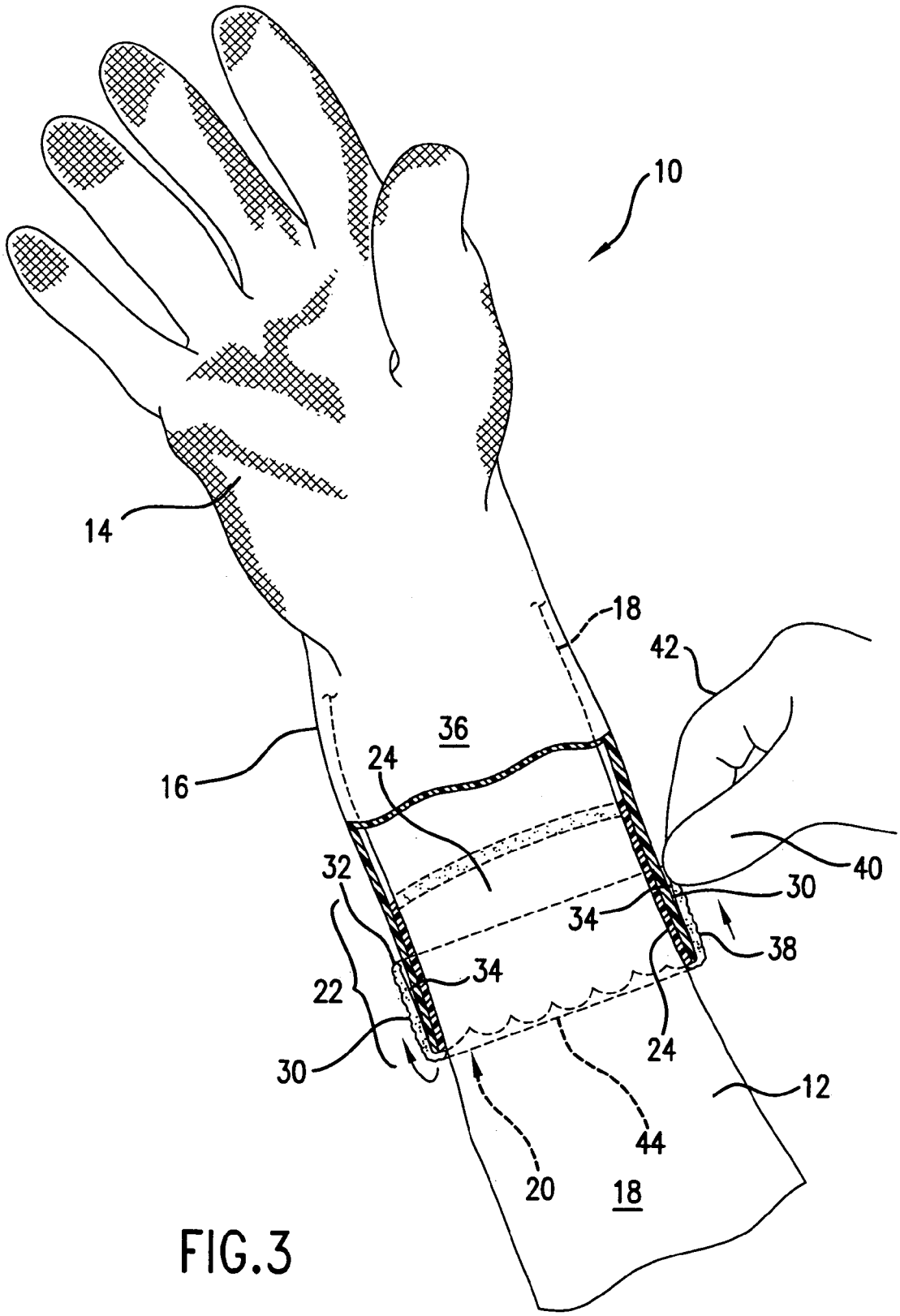
FIG. 3 is a view similar to FIG. 2, but showing the cuff being pulled from the position of FIG. 1 toward the final position of FIG. 4.

As is seen in FIG. 3, the second portion 30 is pinched adjacent the free end 32 thereof by a person's thumb 40 and forefinger 42 so that the surface 34 of the second portion 30 overlies the outer surface 36 of the sleeve 16. This causes the inner surface 38 of the first portion 30 to be exposed outwardly, as is seen in FIGS. 3 and 4.

Figure 4:
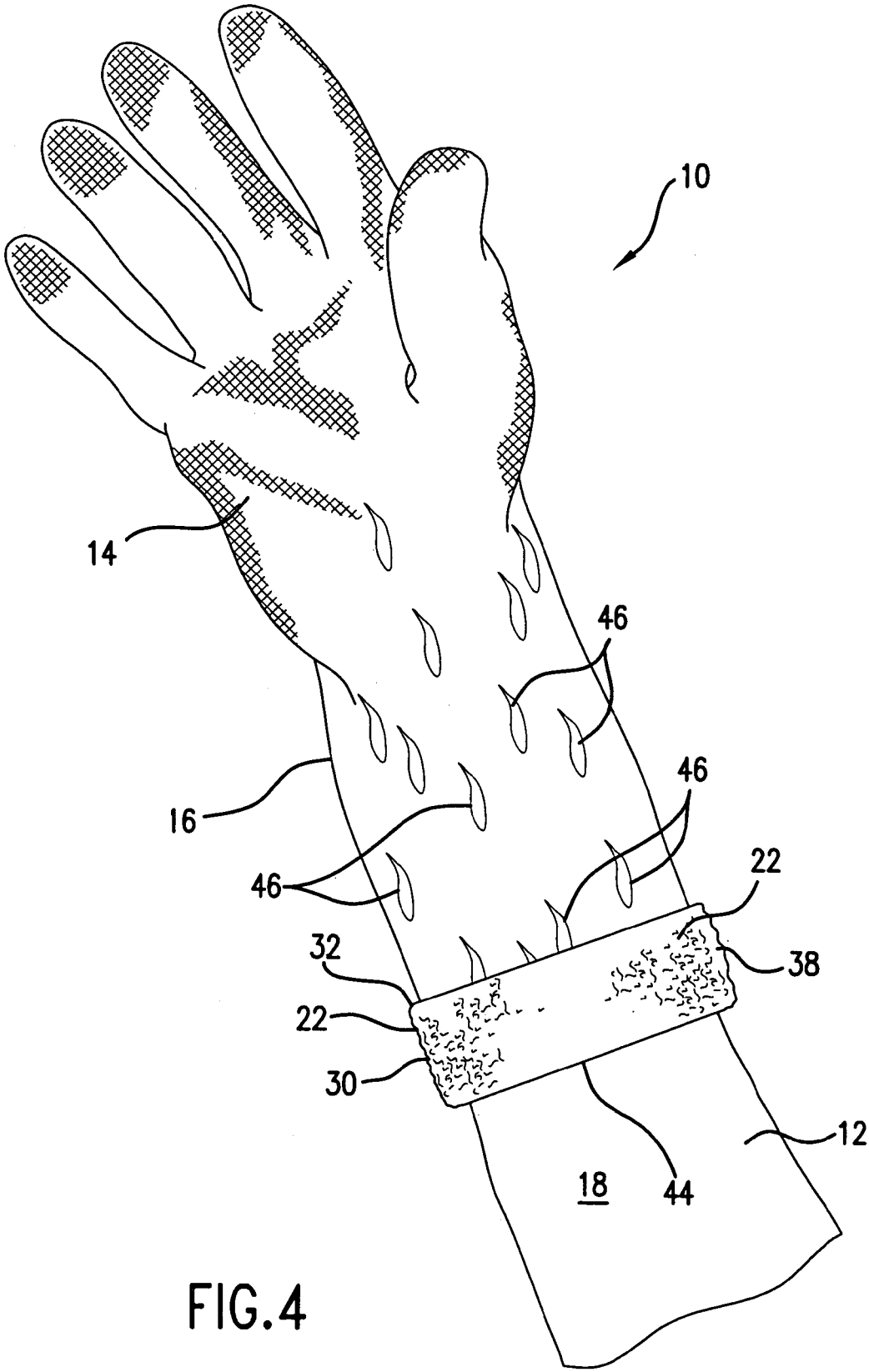
FIG. 4 is a view similar to FIG. 1, but showing cuff pulled over the sleeve of the glove.

Preferably, the surface 38 which is now exposed has a line 44 thereon which becomes visible indicating to the wearer that the second portion 30 of the cuff is now set in the FIG. 4 position to catch moisture 46 which might be flowing downwardly from the hand portion 14 of the glove 10 and along the sleeve 16 toward the person's arm 12. Since the material of at least the second portion 30 is moisture absorbent, the moisture is absorbed into at least the first portion 30 and does not contact the skin 18 of the wearer's arm.

In the preferred embodiment, the first portion 24 which remains inside of the sleeve 16 is hydrophobic so that liquid trapped in the second portion 30 of the cuff 32 does not migrate into the sleeve and contact the person's skin. In another embodiment, the entire cuff 22 is made of the same absorbent material but it is preferred that the first and second portions have different properties, the first portion 24 being hydrophobic so as to repel liquid and the second portion 30 being hydrophilic so as to absorb water.

After use, when the glove 10 is removed from the hand, the cuff 22 dries out in the air as moisture therein evaporates into the atmosphere. The glove 10 is then ready for reuse. When the glove 10 is put back on, it is not necessary to roll the second portion 30 back from the FIG. 4 position to the FIG. 1 position because the glove may be pulled on by simply gripping the surface 38 of the second glove portion 30 and the inside surface 28 of the first glove portion 24 to pull the glove back over the hand and arm 12.

From the foregoing description, one skilled in the art can easily ascertain the essential characteristics of this invention, and without departing form the spirit and scope thereof, can make various changes and modifications of the invention to adapt it to various usages and conditions.

I claim:

1. A glove made of a fluid resistant material that provides a barrier for preventing fluid on an outside surface of the glove from contacting the skin of a wearer's arm adjacent to an inside surface of the glove, the glove having a hand covering portion and an arm covering sleeve portion with an open end through which the wearer's hand and arm are inserted, the improvement comprising:

a cuff having a first portion disposed within the sleeve of a moisture repellant material at a location adjacent to the open end of the sleeve and a second portion of moisture absorbing material initially extending beyond the open end of the sleeve and having first and second surfaces initially facing toward and away from the wearer's arm, the first portion being fixed to the inside surface of the sleeve and the second portion subsequently extending over the outside surface of the sleeve with the first surface of the second portion freely engaging the sleeve when pulled thereover to present a barrier to liquid moving along the sleeve.

2. The glove of claim 1 wherein the moisture absorbing material includes an antibacterial agent.

3. The glove of claim 1 wherein the first portion of the cuff seals against the wearer's arm.

4. The glove of claim 3 wherein the first portion extends about at least an inch into the sleeve from the open end of the sleeve.

5. The glove of claim 4 wherein the first portion extends about 3 inches into the sleeve from the open end.

6. The glove of claim 4 wherein the first portion is adhered to the inside surface of the sleeve with a waterproof adhesive.

7. The glove of claim 6 wherein the first portion of the cuff is hydrophobic to resist accumulation of outside moisture while the second portion is moisture absorbent to minimize movement of moisture from the sleeve to the wearer's arm.

8. The glove of claim 7 wherein the moisture absorbing fabric includes an antibacterial agent.

9. The glove of claim 3 wherein the second portion extends over the outside Surface of the sleeve a distance in a range of about 1½ inch to 2 inches from the open end of the sleeve.

10. The glove of claim 1 wherein the first portion of the cuff is hydrophobic to resist accumulation of outside moisture while the second portion is moisture absorbent to minimize movement of moisture from the sleeve of the wearer's arm.

11. The glove of claim 1 wherein the first portion of the cuff seals against the wearer's arm.

12. The glove of claim 1 wherein the first portion of the cuff is hydrophobic material and the second portion being hydrophilic material so that the first portion repels liquid and the second portion absorbs liquid.

13. A glove made of a fluid resistant material that provides a barrier for preventing fluid on an outside surface of the glove from contacting a wearer's skin adjacent to an inside surface of the glove, the glove having a hand covering portion and an arm covering sleeve portion with an open end through which the wearers hand is inserted, the improvement comprising:

a cuff having a first portion of a hydrophobic material disposed within the sleeve at a location adjacent to the open end of the sleeve and a second portion of a hydrophilic material extending beyond the open end of the sleeve, the first portion being fixed to the inside surface of the sleeve and the second portion extending over the outside surface of the sleeve in direct but non-fixed contact therewith when pulled thereover to present a barrier to liquid moving along the sleeve, the cuff including an antibacterial agent.

14. The glove of claim 13 wherein a visible marking on the inside surface of the cuff indicates when the second portion has been pulled back over the sleeve a sufficient distance to leave the sleeve a sufficient distance to leave the first portion in sealing relation with the wearer's arm.

* * * * *

UNITED STATES PATENT AND TRADEMARK OFFICE

CERTIFICATE OF CORRECTION

PATENT NO. : 7,269,859 B2
APPLICATION NO. : 11/344092
DATED : September 18, 2007
INVENTOR(S) : Wells It is certified that error appears in the above-identified patent and that said Letters Patent is hereby corrected as shown below:

Column 4, line 8 reads "extends over the outside Surface of the sleeve a distance in" should read -- extends over the outside surface of the sleeve a distance in --

Column 4, line 28 reads "through which the wearers hand is inserted, the improve-" should read -- through which the wearer's hand is inserted, the improve- --

Column 4, line 43 reads "distance to leave the sleeve a sufficient distance to leave the" should read -- distance to leave the --

Column 4, insert claim -- 15 The glove of claim 7 wherein the material of the hand and sleeve portions is rubber or latex. --

Signed and Sealed this

Twenty-sixth Day of October, 2010

David J. Kappos

David J. Kappos
*Director of the United States Patent and Trademark Office*